United States Patent [19]

Frankel et al.

[11] B 3,981,899

[45] Sept. 21, 1976

[54] TRIAMINOGUANIDINE CYANOFORMATE

[75] Inventors: Milton B. Frankel, Tarzana, Calif.; Lionel A. Dickinson, Indian Head, Md.

[73] Assignee: The United States of America as represented by the Secretary of the Army, Washington, D.C.

[22] Filed: July 25, 1968

[21] Appl. No.: 747,785

[44] Published under the second Trial Voluntary Protest Program on February 10, 1976 as document No. B 747,785.

[52] U.S. Cl. ..... 260/465.5 R; 149/36

[51] Int. Cl.[2] ..... C07C 121/42

[58] Field of Search ..... 260/465.8 R, 583, 465.5 R; 146/36

[56] References Cited

OTHER PUBLICATIONS

Byrkit et al., Ind. and Eng. Chem., Vol. 42, Sept. 1950, pp. 1862 – 1875.

Lessing, Scientific American, Vol. 189, No. 1, July 1953, pp. 30–33.

*Primary Examiner*—Leland A. Sebastian

*Attorney, Agent, or Firm*—Nathan Edelberg; Vincent W. Cleary

[57] ABSTRACT

A novel polycyano compound and method for the synthesis thereof comprising the reaction of triaminoguanidine with potassium cyanoformate in the presence of a mineral acid.

3 Claims, No Drawings

TRIAMINOGUANIDINE CYANOFORMATE

This invention relates to a novel polycyano compound and method of synthesis thereof, and more particularly to triaminoguanidine cyanoformate (TAGCY).

It is an object of this invention to disclose novel triaminoguanidine cyanoformate having utility as a high energy fuel in propellant systems.

Other objects and a fuller understanding of the invention may be had from the following description and claims.

TAGCY is prepared by the reaction of triaminoguanidine with potassium cyanoformate in the presence of a mineral acid, e.g., sulfuric. The reaction proceeds as follows:

$$NH_2NH\overset{\overset{\displaystyle NNH_2}{\|}}{C}NHNH_2 + KC(CN)_3 \xrightarrow{H_2SO_4} [(NH_2NH)_3O]^+[C(CN)_3]^- + \tfrac{1}{2}K_2SO_4$$

The reactants, i.e., triaminoguanidine and potassium cyanoformate, are prepared in accordance with known procedures. The triaminoguanidine reactant is prepared by reacting guanidine hydrochloride and hydrazine to produce triaminoguanidine hydrochloride (Diamond, Ph.D. Thesis, University of Illinois, 1954; Doctoral Dissertation Series, Publ. No. 10, 466, University Microfilms, Ann Arbor, Michigan). The produced triaminoguanidine hydrochloride subsequently is reacted with liquid ammonia (Benjamin, J. Org. Chem., 29, 3729; 1964) to produce triaminoguanidine. The reaction proceeds as follows:

$$[(NH_2)_3C]^+Cl^- + 3NH_2NH_2 \rightarrow [(NH_2NH)_3C]^+Cl^- + 3NH_3$$

$$[(NH_2NH)_3C]^+Cl^- + NH_3 \xrightarrow{\text{Liq. } NH_3} NH_2NH\overset{\overset{\displaystyle NNH_2}{\|}}{C}NHNH_2 + NH_4Cl$$

The potassium cyanoformate is prepared in a two-step synthesis (Trofimenko, Little and Mower, J. Org. Chem., 27, 433; 1962) from malononitriles as illustrated below:

$$4CH_2(CN)_2 + 8Br_2 + KBr \rightarrow [CBr_2(CN)_2]_4.KBr + 8HBr$$
$$[CBr_2(CN)_2]_4.KBr + 8KCN \rightarrow 4KC(CN)_3 + 4CNBr + 5KBr$$

A specific embodiment of the preparation of the potassium cyanoformate reactant is set forth in Example I below:

EXAMPLE I

A 5-liter, 3-necked flask which had been fitted with a mechanical stirrer, thermometer and reflux condenser, was charged with 770 grams (11.8 moles) of potassium cyanide and 3 liters of 1,3-dimethoxyethane. 1508 grams of a dibromomalonitrile-potassium bromide complex (1.49 moles), prepared as disclosed in Org. Sym., J. Wiley and Sons, Inc., New York, Vol. 39, p. 64, was added in small amounts, with agitation, to the solution which had been cooled to a temperature of around 10°–20°C. The resultant slurry was stirred at room temperature for a period of 2 hours and then brought briefly to reflux. The hot solution was filtered through a preheated sintered-glass funnel and left standing overnight. Several liters of ether were added and the product filtered. 540 grams of a product having a melting point of around 293°–294°C was recovered, which represented a 70.2% yield.

A specific embodiment of the preparation of reactant triaminoguanidine is set forth in Example II below. The triaminoguanidine is prepared in situ by treating triaminoguanidine hydrochloride with liquid ammonia.

EXAMPLE II

A 12-liter, 3-necked flask which had been fitted with a sealed mechanical stirrer, two reflux condensers, and a gas inlet, was charged with 570 grams (6 moles) of guanidine hydrochloride, 1 liter (31.4 moles) of anhydrous hydrazine and 5 liters of 95% ethanol. 95% hydrazine or hydrazine hydrate may be utilized in lieu of anhydrous hydrazine. The reaction mixture was refluxed under nitrogen for 4 hours, cooled and filtered. 685 grams of triaminoguanidine hydrochloride having a melting point of around 230°–232°C was recovered, which represented a yield 81.2%.

480 grams (3.42 moles) of triaminoguanidine hydrochloride was charged into a 5-liter, 3-necked flask having a sealed-in sintered-glass disk and draw-off tube with stopcock in the bottom, and equipped with a sealed mechanical stirrer, drying tube, and gas inlet adapters. The flask was then purged with nitrogen, and about 1800 ml of anhydrous liquid ammonia introduced therein. The mixture was agitated for a period of about 10 minutes, and the formed ammonium chloride solution removed by applying vacuum to the draw-off tube. During the filtration, nitrogen was passed through the flask. The formed triaminoguanidine was treated washed twice with 800 ml portions of liquid ammonia. Nitrogen was drawn through the white crystalline product until all of the ammonia had been removed.

A specific embodiment of the preparation of TAGCY is set forth in Example III below:

EXAMPLE III 441 grams (3.42 moles) of potassium cyanoformate was dissolved in 4 liters of methanol. The resultant dark solution was treated with charcoal and filtered, resulting in a yellow solution, which was added to the flask containing the triaminoguanidine. The reaction mixture was cooled in an ice-bath and 172.3 (1.71 moles) of 95.5% sulfuric acid was added dropwise. After the addition was complete, the reaction mixture was agitated at ambient temperature for several hours, heated to reflux and filtered through a sintered-glass funnel. On cooling, the product rapidly precipitated from the filtrate. The product was recovered, washed with cold isopropanol and dried. 408.5 grams of a product representing a yield of 61.3% was obtained.

The properties of TAGCY are summarized in Table I below:

Table I

| | |
|---|---|
| Structure: | $[(NH_2NH)_3C]^+[C(CN)_3]^-$ |
| Formula: | $C_5H_9N_9$ |
| Melting Point: | 181–183°C (without decomposition) |
| $\Delta H_f$: | +117.4 Kcal/mole (exp.) |
| Density: | 1.43 g/ml at 25°C |
| Impact Sensitivity: | >25 in./l Kg |
| Vac. Thermal Stability: | 0.88 ml gas/g after 408 hours at 75°C<br>0.43 ml gas/g after 42 hours at 100°C |
| Hypergolicity: | Hypergolic with nitrogen tetroxide |

In spite of the fact that TAGCY is such a stable and easily handled compound, it is very energetic, as evidenced by the fact that it will decompose smoothly under pressure in a nitrogen atmosphere. Pressed stands of TAGCY were burned in a Crawford bomb under a nitrogen pressure of 200-1000 psi. The burning rates varied from 0.23 in./sec at 200 psi to 0.46 in./sec at 1000 psi with a pressure exponent of 0.44.

Although we have described our invention with a certain degree of particularity, it is understood that said disclosure is made to set forth a specific embodiment of the invention, and is not intended as a limitation thereof.

Having described our invention, we claim:

1. $[(NH_2NH)_3C] + [C(CN)_3] -$

2. A process for the preparation of the compound of claim 1 comprising the reaction of triaminoguanidine with potassium cyanoformate in the presence of a mineral acid.

3. A process in accordance with claim 2, wherein the mineral acid is sulfuric.

* * * * *